US007462083B2

(12) United States Patent
Ambrico

(10) Patent No.: US 7,462,083 B2
(45) Date of Patent: Dec. 9, 2008

(54) WATER SPORT DEVICE

(76) Inventor: Loris Ambrico, Hochwachtstrasse 35, Steinhausen (CH) CH-6312

( * ) Notice: Subject to any disclaimer, the term of this patent is extended or adjusted under 35 U.S.C. 154(b) by 203 days.

(21) Appl. No.: 11/433,727

(22) Filed: May 12, 2006

(65) Prior Publication Data

US 2006/0260173 A1 Nov. 23, 2006

(30) Foreign Application Priority Data

May 19, 2005 (CH) ..... 866/05

(51) Int. Cl.
*B63H 16/08* (2006.01)

(52) U.S. Cl. ..... 440/21; 440/25; 441/76

(58) Field of Classification Search ..... 440/18, 440/21, 23, 25, 26, 31, 51; 114/55.5, 55.56, 114/55.57; 441/76
See application file for complete search history.

(56) References Cited

U.S. PATENT DOCUMENTS 3,987,749 A * 10/1976 Anderson ..... 440/31
4,795,381 A * 1/1989 Willems ..... 440/26
5,088,944 A 2/1992 Kats ..... 440/26
5,429,064 A 7/1995 Cardenas ..... 114/270
5,542,862 A * 8/1996 Kobayashi ..... 440/38
5,607,331 A * 3/1997 Lekhtman ..... 440/23
6,468,118 B1 * 10/2002 Chen ..... 440/21

FOREIGN PATENT DOCUMENTS

DE 346419 12/1921
DE 1 027 092 3/1958

OTHER PUBLICATIONS http://www.waterbiking.org/EuropeanChampionship2004/index.html.

* cited by examiner

*Primary Examiner*—Rob Swiatek
(74) *Attorney, Agent, or Firm*—McCormick, Paulding & Huber LLP

(57) ABSTRACT

A water sport device that enables a person to walk upright over the water consists of a boat-shaped lower part and an upper part between which a chamber is formed whereby the chamber has an inlet and opens out into an outlet. A drive mechanism actuated with the feet comprises two treadles that can be moved up and down, a propeller in the chamber that can be rotated on a vertical axis and the means for transforming the up and down movement of the treadles into a rotational movement of the propeller. The means preferably comprise a bevel gear and two free-wheel bearings.

16 Claims, 3 Drawing Sheets

WATER SPORT DEVICE

PRIORITY CLAIM

Figure 5:
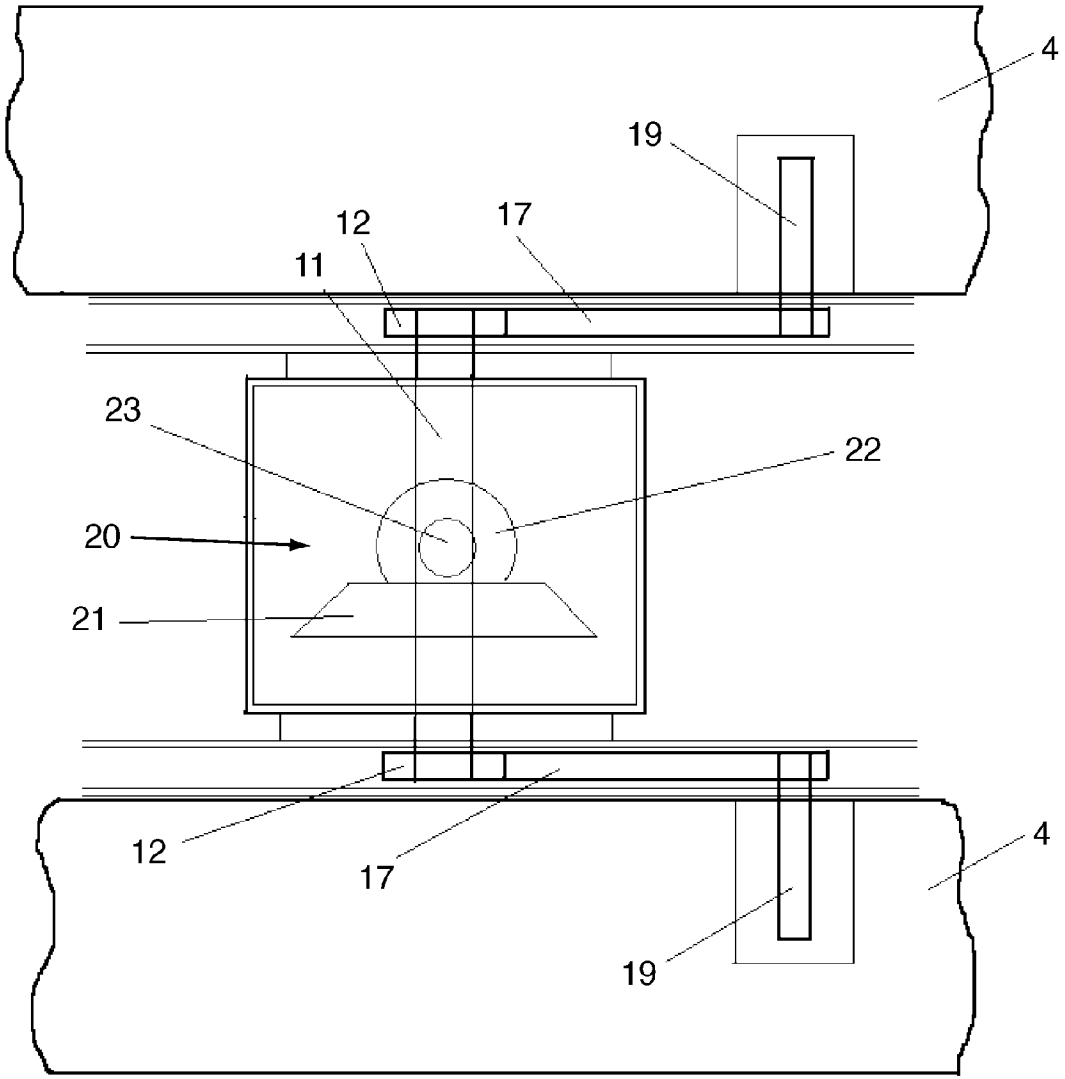

Applicant hereby claims foreign priority under 35 U.S.C § 119 from Swiss Application No. 866/05 filed May 19, 2005, the disclosure of which is herein incorporated by reference.

FIELD OF THE INVENTION

The invention concerns a water sport device for a single person that is driven by muscular force.

BACKGROUND OF THE INVENTION

A muscular driven one-man boat is known from the patent U.S. Pat. No. 5,429,064. The boat has two treadles that can be turned on an axis that are moved reciprocally up and down by the person. A chamber located under each treadle is connected with the surface of the water by an inlet valve and an outlet valve. During the downward movement of the treadle, the inlet valve is closed and the outlet valve is open so that the water located in the chamber is conveyed outwards through the outlet valve. During the upward movement of the treadle, the inlet valve is open and the outlet valve is closed so that the chamber is again filled with water. Therefore, with the alternating upward and downward movement of the treadles one chamber is always filled with water and the other is simultaneously emptied. This leads to rocking movements of the boat that run transversely to the travel direction.

The object of the invention is to develop a water sport device with better driving properties.

SUMMARY OF THE INVENTION

The device in accordance with the invention is a boat-shaped water sport device that comprises a lower part and an upper part between which a chamber is formed, whereby the chamber has an inlet and opens out into an outlet. A drive mechanism actuated with the feet comprises two treadles that can be moved up and down, a propeller in the chamber that rotates on a vertical axis and means of transforming the up and down movement of the treadles into a rotational movement of the propeller. The named means preferably comprise a bevel gear and two free-wheel bearings. A rudder adjustable by means of an electric motor is preferably arranged in the outlet its position being adjustable by means of remote control. The water sport device further comprises a support frame secured to the upper part. It is of advantage when the support frame is secured rotatably on a horizontal axis on the upper part so that it can be folded down and used as a seat by the person for resting during a pause.

BRIEF DESCRIPTION OF THE DRAWING FIGURES

Figure 1:
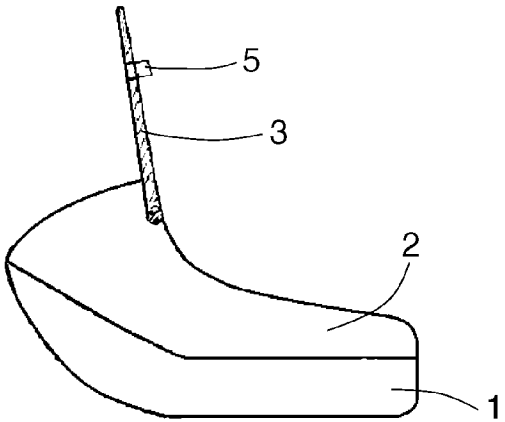
Figure 2:
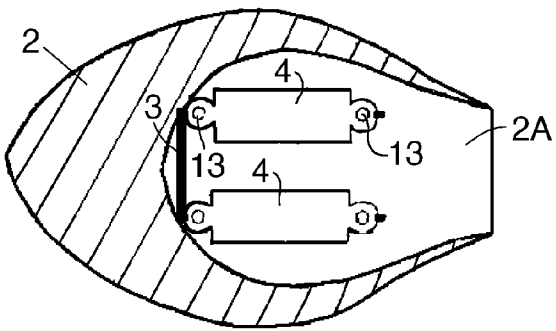
Figure 3:
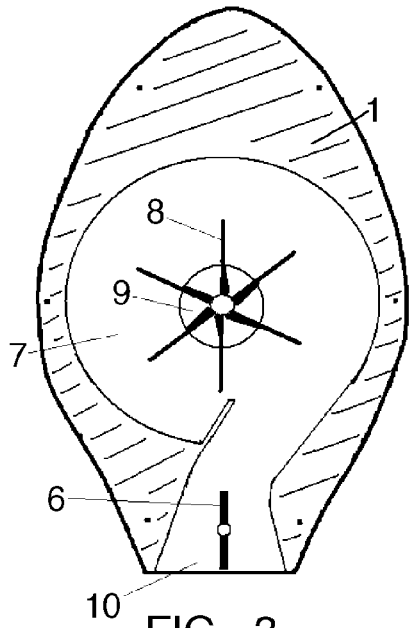
Figure 4:
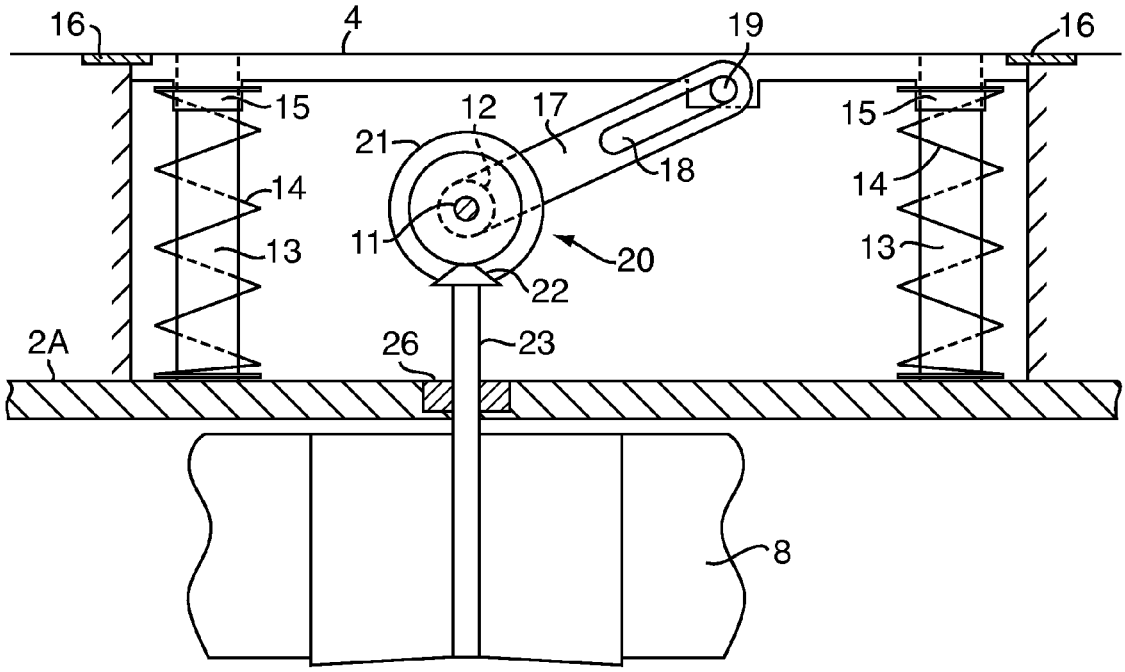
Figure 7:
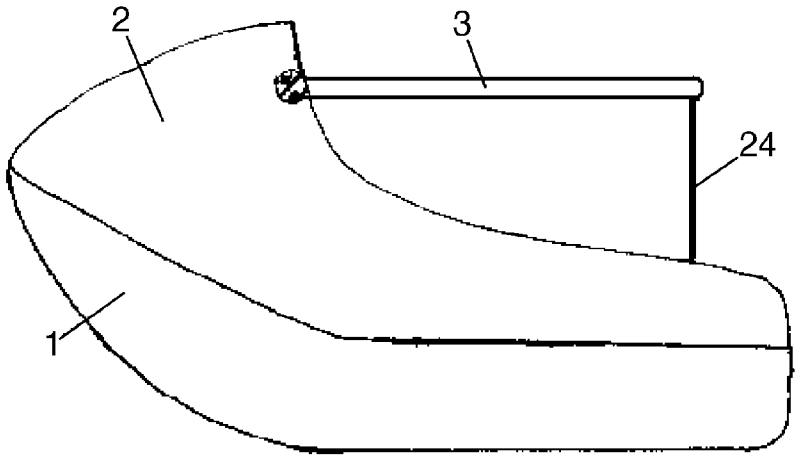
Figure 8:
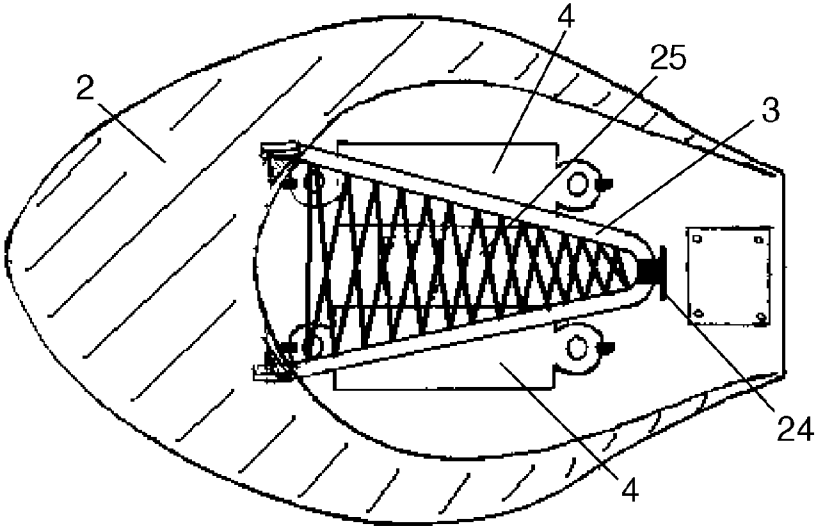
Figure 6:
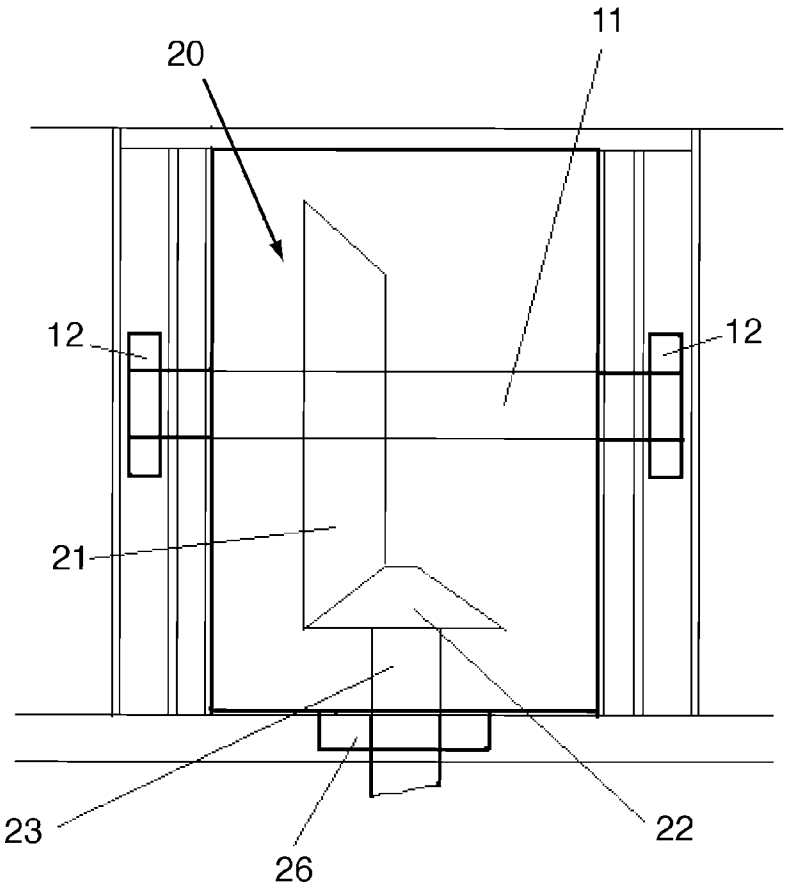

The accompanying drawings, which are incorporated into and constitute a part of this specification, illustrate one or more embodiments of the present invention and, together with the detailed description, serve to explain the principles and implementations of the invention. The figures are not to scale. In the drawings:

FIGS. 1, 2 show a side view and a plan view of a water sport device in accordance with the invention with a drive mechanism actuated by muscular force, FIG. 3 shows a plan view of a lower part of the water sport device, FIG. 4-6 show cross-sectional presentations of the drive mechanism, FIGS. 7, 8 shows a side view and a plan view of the water sport device in a different condition.

DETAILED DESCRIPTION OF THE PREFERRED EMBODIMENT

FIGS. 1 and 2 show a side view and a plan view of a water sport device in accordance with the invention. The size of the water sport device is designed for one single person and is propelled by the person with the feet. The water sport device consists of a lower part 1 formed as a boat-shaped hull and an upper part 2 serving as a cover that are screwed together and sealed with a sealing tape, a support frame 3 and a drive mechanism with two treadles 4. The dimensions of the water sport device have to be adapted to the size and in particular the weight of the user. For a medium-sized person, the dimensions amount typically to a length of 1.4 m and a width of 0.9 m. In order to get the water sport device moving, the person stands upright on the two treadles 4, whereby he steadies himself with both arms on the support frame 3 and shifts his weight alternately to the left and the right foot. In doing so, the two treadles 4 execute up and down movements. The travel direction is controlled by means of a rudder 6 (FIG. 3) operated via a remote control 5. The remote control 5 is secured on the support frame 3 for example with a Velcro fastener.

At the bow, the upper part 2 is strongly raised in order to prevent water getting to the feet of the user. By means of the raised part, a storage space is created where there is room for the personal utensils of the user. Cavities (in the form of recesses) for the treadles 4 and further parts of the drive mechanism are moulded into the floor 2A of the upper part 2.

FIG. 3 shows a plan view of the lower part 1. In the lower part 1 a cylindrical chamber 7 is formed bordered by the floor 2A of the upper part 2 in which a propeller with for example six propeller blades 8 bears rotatably on a vertical axis. Underneath the propeller 8, in the lower part 1, i.e. in the hull of the boat, a hole 9 is provided that serves as the inlet to the chamber 7. The chamber 7 opens out into an outlet 10. The rudder 6 that is adjustable by means of an electric motor is arranged in the outlet 10 and its position determines the travel direction of the water sport device. The rudder 6 or its electric motor is operated via the remote control 5. On using the water sport device, the propeller 8 is brought to turn by a muscular driven drive mechanism explained below so that the water located in the chamber 7 is conveyed to the outlet 10, whereby water flows in behind it through the hole 9. On use therefore, the chamber 7 is permanently filled with water. With its weight, the water present in the chamber 7 contributes substantially to the stabilisation of the water sport device.

The drive mechanism is explained based on FIGS. 4 to 6. The drive mechanism consists essentially of the two treadles 4, the propeller 8 and a means of transforming the up and down movements of the treadles 4 into a rotation of the propeller 8.

FIG. 4 shows a side view of the means that are necessary in order to transform the up and down movement of the left treadle 4 into the rotational movement of a shaft 11. The shaft 11 rotates on a horizontal axis. Each of its ends bears in a free-wheel bearing 12 (FIG. 5, 6). The treadle 4 bears displaceably in vertical direction on two cylinders 13 whereby return springs 14 put over the cylinders 13 resist the down movement of the treadle 4 and ensure that, after pressing down, the treadle 4 automatically moves upwards again as soon as the person relieves the left foot. The treadle 4 is equipped with moulded guide elements 15 that slide with as little friction as possible on the cylinders 13 and ensure that the treadle 4 neither tips laterally nor otherwise tilts. Stoppers 16 ensure that the treadle 4 can not detach itself from the cylinders 13. The up and down movement of the treadle 4 is transmitted via a beam 17 to the free-wheel bearing 12 and transformed into a rotational movement of the shaft 11. The beam 17 includes a slot 18 in which a bolt 19 secured to the treadle 4 engages. The free-wheel bearing 12 only transmits the rotational movement of the beam 17 to the shaft 11 during the down movement of the treadle 4 and not during the up movement of the treadle 4.

The rotational movement of the shaft 11 on the horizontal axis is transformed into the rotational movement of the propeller 8 (FIG. 3) on the vertical axis by means of a bevel gear 20 (FIGS. 5, 6). In the example, the propeller 8 turns in clockwise direction. FIGS. 5 and 6 show a plan view and a side view of the drive mechanism or parts of it. The bevel gear 20 consists of two toothed wheels 21 and 22 arranged orthogonal to one another in a housing. The first toothed wheel 21 is secured to the horizontally aligned shaft 11, the second toothed wheel 22 and the propeller 8 are secured to a vertically aligned shaft 23 whereby the shaft 23 bears on a watertight bearing 26 in order to separate the propeller 8 and the bevel gear 20 in terms of water. The transmission of the bevel gear 20 has a ratio in the range of around 1:3 to around 1:5 depending on the weight class of the user. The number of teeth of the first toothed wheel 21 is therefore greater than the number of teeth on the second toothed wheel 22. For lighter users, the ratio is less than for heavier users.

Once the propeller 8 has been set into motion, the shaft 11 rotates with it. The propeller 8 and the water present between the propeller blades work together as a flywheel. The free-wheel bearings 12 decouple the propeller 8 from the treadles 4. The user himself determines whether and at which speed the treadles 4 are moved up and down. Through the alternate downward movement of the treadles 4, at both ends of the shaft 11 a constant torque is exerted alternately on the propeller 8. In doing so, it is important that the relationship between the size of the propeller and the gear transmission is adapted to one another. In order to do justice to persons of different size and different weight, water sport devices of different size are to be made available with the size of propeller 8 and the gear transmission adapted to the weight class of the person.

The support frame 3 is preferably secured rotatably on a horizontal axis to the upper part 2 so that it can also serve as a seat for the user. FIGS. 7 and 8 show a side view and a plan view of the water sport device when the support frame 3 is folded down serving as a seat. When the user wants to take a break, he folds the support frame 3 downwards into a horizontal position whereby a seat mounting 24 linked to the support frame 3 deflects and supports itself in a slot in the floor of the upper part. The support frame 3 is for example strung with canvas or a tear-resistant tape 25 that serves as a seat. When the support frame 3 is in the horizontal position, it is locked with locking screws. The seat mounting 24 is preferably made of magnetic material so that a torch equipped with a magnet can be secured to the seat mounting 24.

If necessary, the support frame 3 can also be used by the person to pull himself up out of the water onto the water sport device.

The direction of the water sport device is controlled in that the jet of water produced by the propeller 8 is deflected by the rudder 6. As the forces exerted on the rudder 6 are relatively strong, a gear is inserted between the rudder 6 and the electric motor with which the position of the rudder is remotely controlled. The rudder 6 preferably bears on a ball bearing integrated into the upper part 2. The electric motor is supplied with power from a battery or accumulator. Adjusting the rudder 6 is done by means of the remote control 5 that transmits the corresponding control commands to the electric motor.

The water sport device in accordance with the invention is a one-man boat intended for use as a sport or leisure device that enables one person to walk over water with walking movements as carried out on the spot on a conveyor belt. Its dimensions are comparatively small so that it easily has room on the roof-rack of a car. The water sport device has the form of an oval-shaped boat on which the person stands or walks upright. If desired, the person can sit down and rest by folding down the support frame. The drive functions on the principle of a water pump. The water sucked in through the hole in the hull is centrifuged in a round cylinder and conveyed outwards at the back. This is done by the propeller. The force necessary for driving the propeller is achieved by means of step-like movements of the driver. The water sport device is stabilised by means of the amount of water in its bottom. By means of a bevel gear with comparatively high transmission a continuous pressure is exerted on the propeller. Control of the direction is done comfortably via radio from the support frame.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims and their equivalents.

What is claimed is:

1. A water sport device, comprising a boat-shaped lower part and an upper part, wherein a chamber is formed between the lower part and the upper part, the chamber having an inlet and an outlet, a support frame, and a drive mechanism, the drive mechanism comprising two treadles, each being movable up and down, a propeller located in the chamber and rotatable on a vertical axis, and means for transforming the up and down movements of the treadles into a rotational movement of the propeller.

2. The water sport device according to claim 1, wherein said means comprise a bevel gear and two free-wheel bearings.

3. The water sport device according to claim 2, wherein each treadle bears displaceably in vertical direction on two cylinders and wherein return springs are put over the cylinders that resist the down movement of the treadle.

4. The water sport device according to claim 3, wherein a rudder adjustable by means of an electric motor is arranged in the outlet of the chamber the position of which is controlled by means of remote control.

5. The water sport device according to claim 4, wherein the support frame is secured rotatably on a horizontal axis to the upper part.

6. The water sport device according to claim 3, wherein the support frame is secured rotatably on a horizontal axis to the upper part.

7. The water sport device according to claim 2, wherein a rudder adjustable by means of an electric motor is arranged in the outlet of the chamber the position of which is controlled by means of remote control.

8. The water sport device according to claim 7, wherein the support frame is secured rotatably on a horizontal axis to the upper part.

9. The water sport device according to claim 2, wherein the support frame is secured rotatably on a horizontal axis to the upper part.

10. The water sport device according to claim 1, wherein each treadle bears displaceably in vertical direction on two cylinders and wherein return springs put over the cylinders resist the down movement of the treadle.

11. The water sport device according to claim 10, wherein a rudder adjustable by means of an electric motor is arranged in the outlet of the chamber the position of which is controlled by means of remote control.

12. The water sport device according to claim 11, wherein the support frame is secured rotatably on a horizontal axis to the upper part.

13. The water sport device according to claim 10, wherein the support frame is secured rotatably on a horizontal axis to the upper part.

14. The water sport device according to claim 1, wherein a rudder adjustable by means of an electric motor is arranged in the outlet of the chamber the position of which is controlled by means of remote control.

15. The water sport device according to claim 14, wherein the support frame is secured rotatably on a horizontal axis to the upper part.

16. The water sport device according to claim 1, wherein the support frame is secured rotatably on a horizontal axis to the upper part.

* * * * *